United States Patent [19]

Motobayashi et al.

[11] 4,169,019

[45] Sep. 25, 1979

[54] METHOD OF PRODUCING A CHROMIUM-PLATED COMBING ROLLER

[75] Inventors: Kozo Motobayashi, Kasugai; Noriaki Miyamoto, Kariya, both of Japan

[73] Assignee: Kabushiki Kaisha Toyoda Jidoshokki Seisakusho, Kariya, Japan

[21] Appl. No.: 915,771

[22] Filed: Jun. 15, 1978

Related U.S. Application Data

[63] Continuation of Ser. No. 839,753, Oct. 5, 1977, abandoned, which is a continuation-in-part of Ser. No. 672,532, Mar. 31, 1976, abandoned.

[30] Foreign Application Priority Data

Apr. 3, 1975 [JP] Japan ..... 50-45123

[51] Int. Cl.[2] ..... C25D 5/02; C25D 7/00

[52] U.S. Cl. ..... 204/15; 19/114; 204/25

[58] Field of Search ..... 204/15, 25

[56] References Cited

U.S. PATENT DOCUMENTS

| | | | |
|---|---|---|---|
| 3,387,338 | 6/1968 | Kanai et al. | 19/114 |
| 3,640,789 | 2/1972 | Hepfer | 156/150 |

FOREIGN PATENT DOCUMENTS

| | | | |
|---|---|---|---|
| 2116951 | 4/1971 | Fed. Rep. of Germany | 19/98 |
| 1551309 | 11/1968 | France | 19/114 |
| 333669 | 8/1930 | United Kingdom | 19/114 |

*Primary Examiner*—T. M. Tufariello

*Attorney, Agent, or Firm*—Wenderoth, Lind & Ponack

[57] ABSTRACT

An electroplated combing roller for use in a spinning unit of an open end spinning machine comprises an aluminum alloy cylindrical body, and a steel wire fixedly mounted in the cylindrical body. A hardened chromium plating is carried out after mounting the steel wire onto the aluminum alloy cylindrical body and the dimensions of the steel wire and aluminum alloy cylinder are interrelated in a manner such that only the exposed surface of the steel wire is plated with the hardened chromium while the exposed surface of the aluminum alloy cylinder is not so plated.

5 Claims, 6 Drawing Figures

METHOD OF PRODUCING A CHROMIUM-PLATED COMBING ROLLER

This is a continuation application of U.S. Pat. application Ser. No. 839,753, filed Oct. 5, 1977 now abandoned, which is a continuation-in-part of our U.S. copending patent application, Ser. No. 672,532, filed Mar. 31, 1976, abandoned entitled "Chromium-plated Combing Roller."

BACKGROUND OF THE INVENTION

This invention relates generally to open-end spinning machines and, more particularly, to a method of producing electroplated combing rollers employed in spinning units of the open-end spinning machine.

In an open-end spinning machine including a succession of spinning units, a combing roller with fiber-gripping means is employed in each spinning unit to open up a sliver into individual fibers. The fiber-gripping means comprise a metallic wire with a fiber-gripping surface consisting of a plurality of spaced needles or spikes, which undergo strong friction during the combing-out operation due to contacts with the fibers and will become worn away. The friction which is generated is very strong, especially when the slivers undergoing this operation are synthetic materials. Therefore, in order to restrain the abrasion which the fiber-gripping surface must undergo, and to improve the effective life of the entire fiber-gripping means, the fiber-gripping surface must be provided with some wear-resistant layer. In a carding machine, this wear-resistant layer normally consists of a layer of hardened chromium and it has not been found that a similar layer can be provided in an open spinning machine, because it exhibits a good wear-proof property and can be obtained at a low manufacturing cost. At the same time, the fiber-gripping means itself is formed from carbon steel because it has been found to provide the highest physical strength against the pulling forces of the fibers.

With respect to the cylindrical body which forms the basic constructional element of the combing roller in which the fiber-gripping means are mounted spirally, the combing roller is made of light aluminum alloy which, because of its lightness, helps to save in the overall total power consumption which is required to operate the open-end spinning machine.

Since the combing roller must necessarily be at a relatively small diameter (50–60 mm), this makes it very difficult to wind a previously hardened, chromium plated fiber-gripping means around the cylindrical body without cracking or breaking the chromium plated layer. Of course, a cracked or broken layer of chromium would seriously hamper the effective operation of the combing roller. Therefore, it would be preferable to have a fiber-gripping means of carbon steel which has not been previously plated or coated with chromium wound around the aluminum cylindrical body of the combing roller and fitted into the recesses therein, and thereafter have a hardened chromium layer electroplated to both the aluminum cylindrical body and the steel fiber-gripping means simultaneously.

The inventors of the present invention, however, encountered many difficulties when trying to electroplate both the steel fiber-gripping means and aluminum cylindrical body with hardened chromium at the same time and under the same conditions. Specifically, in the case of hardened chromium, it is very difficult to provide a uniform deposition thereof on a cathode in an electroplating process since the thickness of the hardened chromium deposit is greatly influenced by the magnitude of current density, and, as a result, it is very difficult to obtain good adherence of the hardened chromium to the aluminum, since the aluminum may easily have thereon an oxide film which, in electroplating, prevents the formation of deposit nuclei thereon. It is, therefore, understood that when the plating is effected after the mounting of the fiber-gripping means around the cylinder, the hardened chromium layer formed on the cylindrical aluminum alloy body tends to be incomplete; this can cause problems. Incompleteness causes the portions of chromium on the aluminum body to peel away during the combing out operation due to the great stress which the body must undergo, and therefore the fibers being separated are caught by the poorly plated portions of chromium and, as a result, the yarn may break or the yarn quality will be greatly lowered.

Since it is still necessary to coat the wires but not the aluminum cylindrical body, attempts have been made at masking the aluminum cylindrical body during the time the wires wound therearound are plated. Masking the aluminum cylindrical body, while leaving the wires extending thereabove free to receive the chromium plate, however, is no simple task. The mask must be essentially very narrow to fit between the wound metallic wires and must be carefully positioned between the wires. Due to the small sizes which are involved, this masking technique is very expensive because of the detailed work which is required.

SUMMARY OF THE INVENTION

To overcome the difficulties which arise in the masking technique for preventing the chromium from plating to the aluminum cylindrical body, the present invention was developed. According to the present invention, the fiber-gripping means of carbon steel, prior to the electroplating process, are mounted in the aluminum cylindrical body of the combing roller that the circumferential surface of each land portion of the aluminum alloy body between the thin fiber-gripping means is positioned beneath the shoulder of the fiber-gripping means a predetermined distance and thereby defines a specific recess having a predetermined depth between the adjacent fiber-gripping means. The electroplating process is then carried out.

This specific recess which is formed between the fiber-gripping means and yet still above the aluminum cylindrical surface makes it much more difficult to plate the aluminum alloy with the hardened chromium, and therefore results in only the surface of the fiber-gripping means outside of the recess in which it is positioned around the cylinder being provided with the hardened chromium layer. The depth of this additional recess must be at least 5 mm. To further enhance the prevention of chromium formation on the aluminum cylinder, an additional V-shaped groove may be formed in the land portion between the fiber-gripping means. This additional V-shaped should be at least 0.3 mm in depth. By so doing, the chromium is further prevented from forming on any surface of the combing roller except for the projecting carbon steel portions of the fiber-gripping means.

BRIEF DESCRIPTION OF THE DRAWINGS

The invention will become more readily apparent from the following detailed description taken in conjunction with the accompanying drawings in which.

DESCRIPTION OF THE PREFERRED EMBODIMENT

Figure 1:
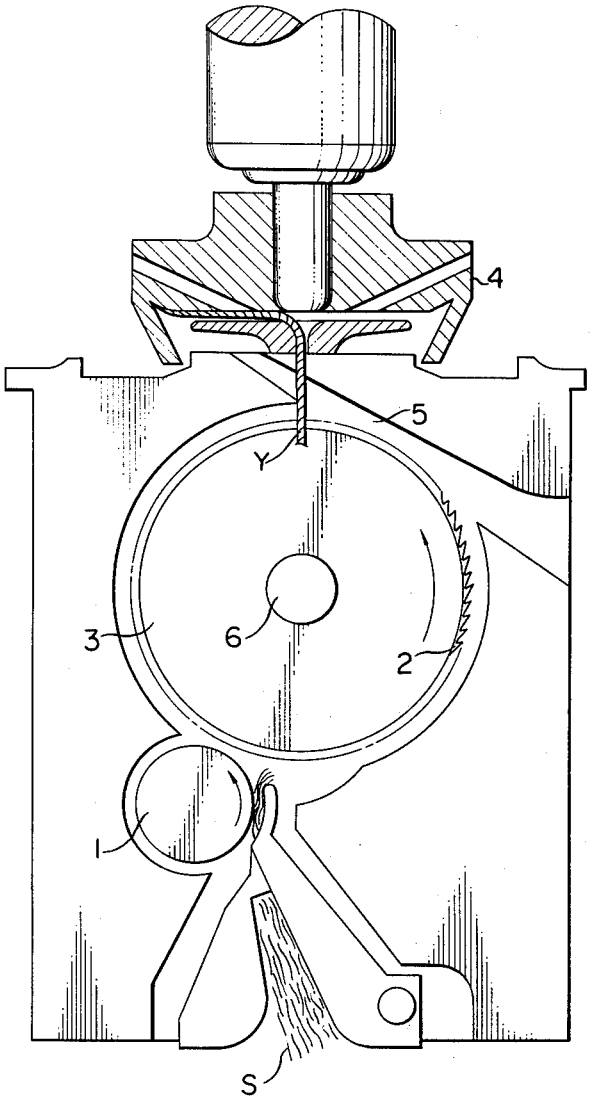
FIG. 1 is a section showing an open-end spinning unit including a combing roller according to the invention.

Referring now to the drawings, there is shown in FIG. 1 a spinning unit for an open-end spinning machine, in which a supplied sliver S is fed by means of a feed roller 1 to a combing zone in the spinning unit, where it is opened up into individual fibers. The individual fibers are fed by a combing roller 3, which is provided with fiber-gripping means 2 as hereinafter described in detail, to a doffing zone through which they are introduced into a rotary spinning chamber of a rotor 4 with a flow of air flowing toward the spinning chamber through a passageway 5, the air flow being generated due to the rotation of the rotor 4. In the spinning chamber, the fibers are spun and produce a yarn Y in a conventional manner. The feed roller 1, the combing roller 3 and the spinning rotor 4 are driven by suitable mechanisms; however, descriptions of the driving mechanisms are omitted, because they may be of conventional design. A reference numeral 6 shows a driving shaft disposed in driving engagement with the combing roller 3.

Figure 2:
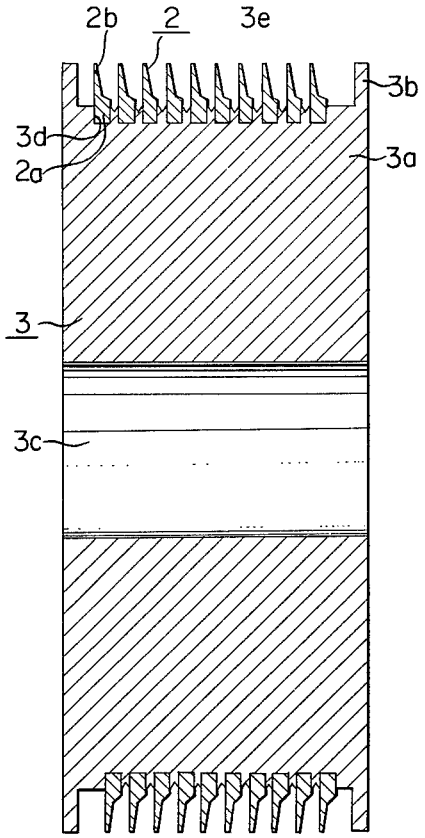
FIG. 2 is a section of the combing roller of FIG. 1 before it is plated with hardened chromium.

The combing roller 3 in the state before it is plated with hardened chromium is shown in FIG. 2. The combing roller 3 comprises a substantially cylindrical body 3*a* having radially outwardly extending flanges 3*b* integrally formed at the opposite ends thereof, and having a through opening 3*c* centrally provided to receive the driving shaft 6 (FIG. 1). The cylindrical body 3*a* may be made of suitable light alloy as aluminum alloy. Recesses 3*d* for receiving the fiber-gripping means 2 are provided in the circumference of the cylindrical body 3*a*. In the embodiment, although the recesses 3*d* consist of a single helical channel-like groove, they may comprise a double helical groove, a plurality of axially spaced annular grooves, or other suitable recesses. The fiber-gripping means 2 comprise metallic wires, which are usually made of steel, have a root portion 2*a* emplanted in and along the recess means 3*d*, and a plurality of fiber-engaging portions 2*b* in the form of needles or spikes extending from the root portion 2*a* of the fiber-gripping means has a cross section complementary to the recess 3*d*.

For example, in the case of a combing roller for cotton fibers, the roller is provided with 127 spikes 2*b* per square inch and, in the case of a combing roller for synthetic fibers, 57 spikes 2*b* are provided per square inch.

Figure 3:
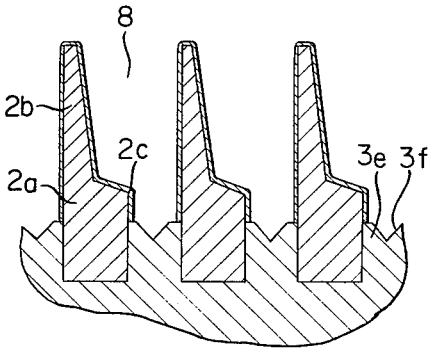
FIG. 3 is an enlarged sectional view fragmentally showing the plated combing roller according to the invention.

It is essential that the height of the root portion 2*a* be larger by a predetermined amount than the depth of the recess 3*d* in order to provide only a surface portion of the fiber-gripping means 2, exposed to the surrounding electrolyte, with a layer of hardened chromium. After the fiber-gripping means 2 is emplanted in the recess means 3*d* provided in the cylindrical body 3*a*, land portions 3*e* between the adjacent recess portions of the cylindrical body 3*a* are generally deformed in a V-shape as shown in FIG. 3 by using a suitable tool (not shown), such as, a caulker to fixedly secure the fiber-gripping means 2 to the cylindrical body 3*a*.

At this time, possible gaps between the root portion 2*a* of the fiber-gripping means 2 and the side walls of the groove 3*d* are completely closed when the adjacent land portions 3*e* are deformed, thereby eliminating a possibility that the fibers are engaged in the gaps. Even if the gaps are present after the fixing of the fiber-gripping means 2, the fibers will not reach the surface 3*f* of the land portion 3*e* during the combing-out operation, because the diameter of the cylindrical body 3*a* measured to the land portion 3*e* thereof is decreased as compared with the same size of the prior art combing roller to provide the predetermined amount of diametrical difference between the shoulder 2*c* and the surface 3*f*. That is, the fibers are allowed to reach about the shoulder 2*c* during the combing-out operation. Therefore, it is understood that the gaps, even if present, have no effect on the combing-out function of the combing roller 3. Additionally, it is also noted that the above structure eliminates the need for electroplating the surface 3*f* of the cylindrical body 3*a* with hardened chromium.

After fixing the fiber-gripping means 2, the combing roller 3 is dipped in a solution of 200–250 gr. of chromic anhydride crystal and 2–2.5 gr. of sulphuric acid per 1 liter of water. A temperature of the solution is maintained within 50° to 60° C. These conditions of the solution are the usual conditions in chromium-electroplating. The opposed flanged sides and flanges 3*b* of the cylindrical body 3*a* are preferably masked with members 7 (see FIG. 4), which are hereinafter described in detail. A thickness of the electroplated part of hardened chromium layer depends upon a length of time and a quantity of electricity made available in the electrolytic deposition. It is found that, in order to cause substantially only the exposed surface of the fiber-gripping means 2 to be hardened chromium-plated, the length of time is preferably within 30 to 90 minutes and the quantity within 10 to 20 amperes. In the case of the combing roller for the synthetic fibers, the optimum length of time and the optimum quantity of electricity are about 45 minutes and 15 amperes, respectively.

In the art of electroplating, it is known that relatively narror or deep recesses in a workpiece should be avoided in order to assure a uniform build-up of section thickness. Although not shown, with the prior art combing rollers, a shoulder or stepped portion 2*c* (see FIG. 3) of the fiber-gripping means 2 is flush with the surface 3*f* of the land portion 3*d* of the cylindrical body 3*a*. According to the invention, however, a space or recess 8 between the adjacent portions of the fiber-gripping means 2 is increased in depth by lowering a level of the surface 3*f* toward the center of the cylindrical body 3*a*. That is, the surface 3*f* is lowered to provide an additional recess of a predetermined distance of about 0.5 mm relative to the shoulder 2*c* of the fiber-gripping means. This additional recess causes the surface 3*f* of the land portion of the cylindrical body 3*a* not to be plated with hardened chromium, since the lowered surface 3*f* is allowed to attract only little positive chromium ions due to the nature of electricity when a d-c voltage causes the combing roller to become negative.

As described herinbefore, the surface 3*f* of the cylindrical body 3*a* after the fiber-gripping means 2 has been fixedly secured thereto forms the V. This makes it more difficult to plate the surface 3*f* with hardened chromium. Even if the surface 3*f* is hardened chromium-plated, the film of deposited hardened chromium is very thin and incomplete as compared with that formed on the exposed surface of the fiber-gripping means 2. Therefore, it can be readily removed from the surface 3*f* by using a wire brush (not shown).

To show the effectiveness of providing this additional recess, the following experiment was undertaken in which the recess between the rolls of wire was less than 0.5 mm and greater than 0.5 mm.

The conditions for the plating of the hardened chromium onto the metallic wire were as follows:

| | |
|---|---|
| Composition of Processing Bath | |
| Crystal of Chrome Oxide | 250g |
| Sulfuric Acid | 2.5g |
| Water | 1.0 litre |
| Temperature | 50° C. |
| Current | 15A/Bath |
| Gages of Metallic Wires | |
| Height of Fiber-Gripping Means | 4.0mm |
| Height of Shoulder | 1.5mm |
| Width of Groove | 1.1mm |
| Depth of Groove | 1.0mm |
| Width of Land | 0.9mm |
| Depth of V | 0.3mm |

Figure 5:
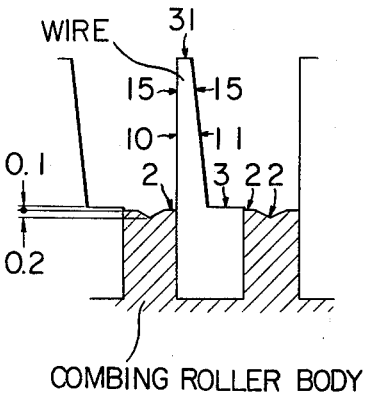
FIGS. 5 and 6 show the distribution of the film thickness of the hardened chromium formed by plating.
Figure 6:
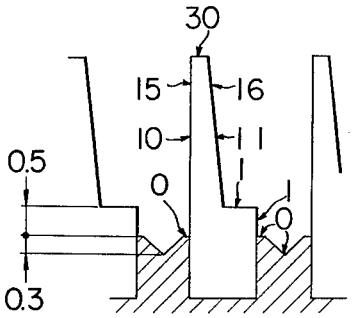

FIGS. 5 and 6 show the distribution of the film thickness of the hardened chromium in microns formed by plating in the above example. As can be seen from these figures, when the shoulder portion of the metallic wire projects greater than 0.5 mm above the surface of the aluminum substrate, no chromium is plated onto the substrate.

In both FIGS. 5 and 6, the numerals associated with the various portions of the cylindrical body and the wire indicate the thickness of the chromium plated layer. It can be seen in FIG. 5 that when the height of the shoulder is 0.1 mm, the combing roller body (the aluminum substrate) is plated with chromium, to a depth referred to as "2," while in the second figure, where it is shown that the shoulder of the tooth extends 0.5 mm above the surface of the substrate and wherein an additional groove of 0.3 mm is provided below the surface of the substrate, no plating at all occurred on the substrate or within the groove in the substrate as indicated by the 0 marking. The remaining numbers on the drawings represent the relative plating thicknesses on the metallic wire.

Figure 4:
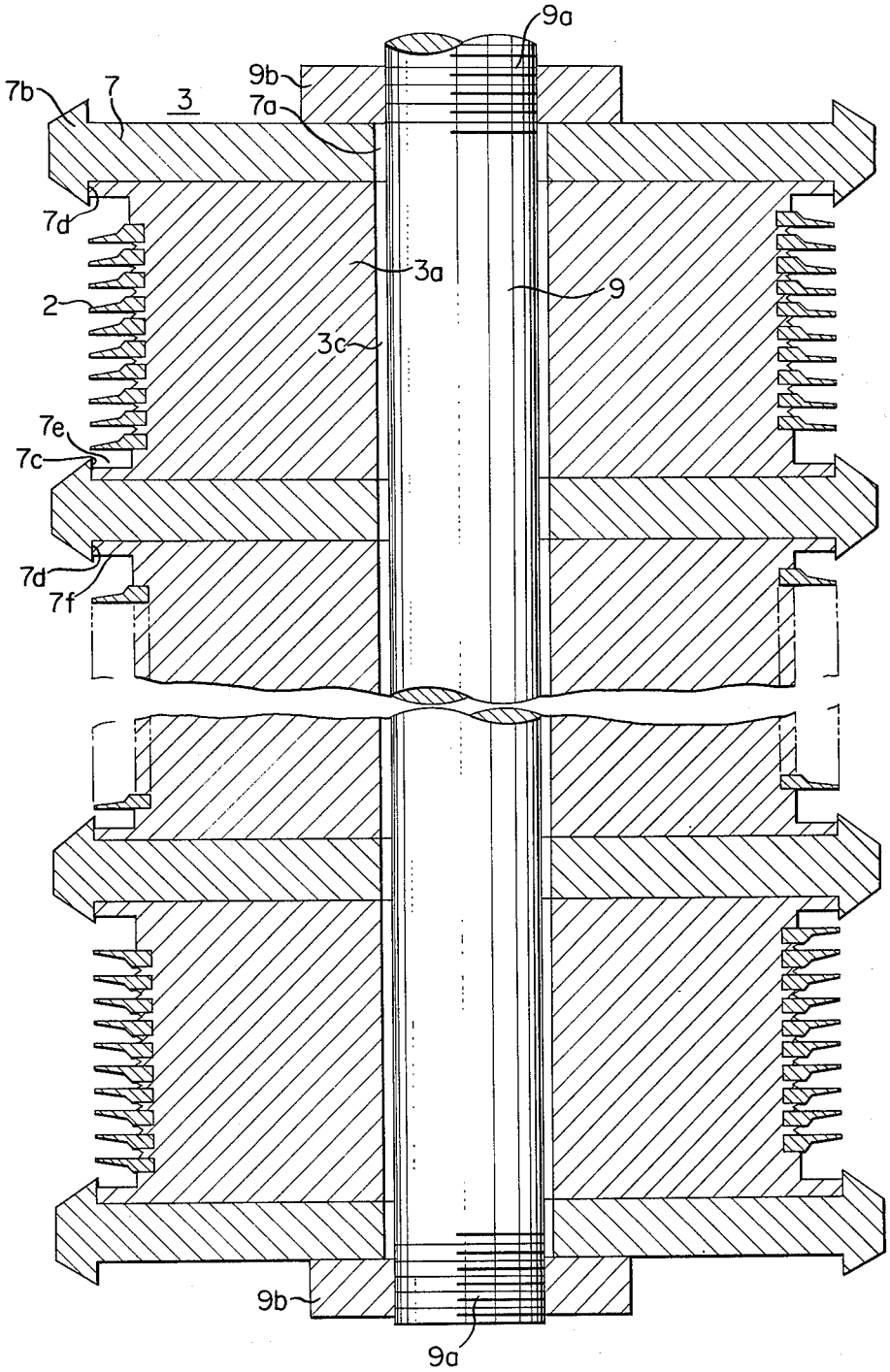
FIG. 4 is a longitudinal sectional view of a plurality of combing rollers supported by a device for preventing the cylindrical bodies of the combing rollers from being hardened chromium-plated.

From the above results, it can be understood that by providing a specific shoulder of recession between the wires wound around the aluminum substrate, chromium can be effectively prevented from being plated onto the aluminum substrate. Furthermore, by providing the V-groove between the shoulders of the wires, the formation of the plating surface on the substrate is also prevented. In this manner, the weight of the aluminum substrate roller can be kept to a minimum, since there is no chromium plated thereon, and there is no necessity to involve the cumbersome method of masking the substrate between these wires to prevent the chromium from forming thereon.

Where it is desired to electroplate a plurality of combing rollers 3 with hardened chromium, they are dipped in the electrolyte while supported by a device as shown in FIG. 4. The device can generally support about 10–20 combing rollers 3 and comprises a shaft means 9 extending through the center openings 3*c* of the stacked combing rollers 3. The shaft 9 has opposed screw threaded end portions 9*a*, between which the combing rollers 3 are tightly held by means of nuts 9*b* engaging the screw threaded end portions 9*a* of the shaft 9. In order to prevent the opposed sides and flanges 3*b* of each combing roller 3 from being plated with hardened chromium, the combing roller 3 mounted around the shaft 9 is disposed between the disk-like members 7, each having an opening 7*a* for the shaft 9 to extend therethrough. The disc-like member 7 has an annular flange portion 7*b* of a trapezoid shape in cross section, and the upper and lower inner surfaces 7*c* and 7*d* of the annular flange portion 7*b* are adapted to extend upwardly and downwardly a predetermined amount, respectively, beyond the thickness of each lower flange 3*b* of the adjacent upper cylindrical body 3*a* and the upper flange 3*b* of the adjacent lower cylindrical body, respectively. Thus, it is understood that the upper and lower inner surfaces 7*c* and 7*d* define recesses 7*e* and 7*f* in cooperation with the flanges 3*b* of the adjacent cylindrical bodies, respectively, and therefore the surfaces of the flanges 3*b* facing the recesses 7*e* and 7*f* are prevented from being plated. It is noted that the cross-sectional shape of the annular flange portion 7*b* is not limited to trapezoid and other suitable shape such, for example, as a semi-circular shape may be employed. Also, it is noted that the flange portions 7*b* of the uppermost and lowermost disc-like members 7 may not have the upper and lower inner surfaces 7*c* and 7*d*, respectively.

During the electroplating operation, such an assembly of combing rollers 3 is dipped into the electrolyte by the supporting device therefor, to which the cathode of a source of electricity (not shown) is connected. In order to complete the electric circuit through the assembly, in the embodiment illustrated in FIG. 4, at least the upper nut 9*b* and all the disc-like members 7 other than the lowermost disc-like member must be made of suitable electric conductive material, such as iron, aluminum, etc. In this case, the sharp-pointed surfaces of the flange portions 7*b* of the disc-like member and the upper nut 9*b* may be masked with an electrically insulating coating, such as a plastic, to prevent the flange portions 7*b* from being hardened chromium-plated, because the sharp-pointed surfaces cause the current density to be increased thereat and are readily plated with hardened chromium. In the case where the shaft 9 is made of electrically conducting material, such as iron and is associated with the combing rollers in electrically conducting relations, the disc-like members 7 may be made of suitable electrically insulating material. The lowermost disc-like member 7 may be an integral part of the shaft 9 and in this case the lower nut 9*b* can be omitted.

What we claim is:

1. A method of producing an electroplated combing roller for use in a spinning unit of an open-end spinning machine comprising:

providing a cylindrical body of aluminum alloy with a plurality of first recesses around the circumference thereof spaced from each other with land portions between said recesses;

fixedly mounting in said first recesses a plurality of steel fiber-gripping means for gripping the slivers to be separated into individual fibers, each fiber gripping means having:

a root portion mounted in and extending out of said first recess, a narrower gripping portion formed with said root portion and projecting outward therefrom, and a shoulder portion at the junction of said root portion and gripping portion, said shoulder being spaced above said cylindrical body, whereby second recesses are formed between adjacent root portions of adjacent fiber-gripping means extending out of said first recesses; and dipping said cylindrical body and said fiber-gripping means fitted therein into a chromium electrolyte solution and electroplating only said fiber-gripping means, whereby a layer of hardened chromium is electroplated onto only the exposed surfaces of said fiber-gripping means projecting from said cylindrical body.

2. A method as claimed in claim 1 wherein said second recesses have a depth of approximately 0.5 mm.

3. A method as claimed in claim 2 wherein the diameter of said cylindrical body is 50–60 mm.

4. A method as claimed in claim 3 wherein the circumferential surface of said cylindrical body between said first recesses has a V-like contour.

5. A method as claimed in claim 4 wherein a depth of said V-like contour is about 0.3 mm.

* * * * *